US005865047A

United States Patent [19]

Yoon et al.

[11] Patent Number: 5,865,047

[45] Date of Patent: Feb. 2, 1999

[54] PULSATOR FOR A WASHING MACHINE

[75] Inventors: Chong-Man Yoon; Ki-Hyun Lim; Jeom-Gap Kim, all of Seoul; Jong-Chil Lee, Incheon, all of Rep. of Korea

[73] Assignee: Daewoo Electronics Co., Ltd., Rep. of Korea

[21] Appl. No.: 848,640

[22] Filed: Apr. 29, 1997

[30] Foreign Application Priority Data

Apr. 29, 1996 [KR] Rep. of Korea ..... 1996 9772
Apr. 29, 1996 [KR] Rep. of Korea ..... 1996 13537

[51] Int. Cl.[6] ..... D06F 17/10

[52] U.S. Cl. ..... 68/134

[58] Field of Search ..... 68/133, 134, 23.6, 68/23.7; 366/276, 278, 279, 243, 314

[56] References Cited

U.S. PATENT DOCUMENTS

| | | | |
|---|---|---|---|
| Re. 19,514 | 4/1935 | Dehle | 68/134 |
| 1,729,751 | 10/1929 | Snyder | 68/133 |
| 1,866,779 | 7/1932 | Snyder | 68/133 |
| 2,021,097 | 11/1935 | Maus | 68/133 |
| 2,416,611 | 2/1947 | Castricone | 68/134 |
| 4,594,863 | 6/1986 | Oida | 68/134 |
| 5,239,847 | 8/1993 | Lee | 68/134 |
| 5,421,174 | 6/1995 | Kim et al. | 68/134 |
| 5,440,903 | 8/1995 | Kropf | 68/134 |
| 5,473,916 | 12/1995 | Ye | 68/134 |
| 5,680,780 | 10/1997 | Kim et al. | 68/134 |

FOREIGN PATENT DOCUMENTS

| | | | |
|---|---|---|---|
| 261493 | 12/1985 | Japan | 68/134 |
| 1 150 449 | 4/1969 | United Kingdom . | |

*Primary Examiner*—Amy B. Vanatta
*Attorney, Agent, or Firm*—Cushman Darby & Cushman Intellectual Property Group of Pillsbury Madison & Sutro, LLP

[57] ABSTRACT

A pulsator, which is installed in a washing tub of a washing machine, includes a base, a post protruded upwardly from a upper surface of the base, a plurality of blades extended radially with respect to the post and outwardly the base, and protruded upwardly on the upper surface of the base, and a plurality of vanes formed on a upper portion of the post, extended radially and outwardly with respect to the upper portion of the post. The plurality of blades develop a heart-type water flow in the washing tub, and the a plurality of vanes develop a water flow at a central portion of the heart-type water flow, thereby the twisting and tangling of the laundry caused by the heart-type water flow can be minimized.

16 Claims, 5 Drawing Sheets

PULSATOR FOR A WASHING MACHINE

BACKGROUND OF THE INVENTION

1. Field of the Invention

This invention is related to a washing machine, more particularly to a pulsator for a washing machine installed in a washing tub so as to develop a vortex-type water flow.

2. Description of the Prior Art

Generally, a vortex-type washing machine is designed to wash laundry by operating a pulsator in forward and reverse directions, and various kinds of pulsator have been proposed for improvement of washing efficiency.

One example of a pulsator is disclosed in U.S. Pat. No. 5,239,847. The pulsator suggested in U.S. Pat. No. 5,239,847 includes a base and a plurality of blades which project generally radially outwardly along the base. Each blade, which is generally of an S-shape as viewed in plan, includes first and second sides which mutually have different inclinations with respect to the vertical direction. The first side is of a steeper inclination than the second side along a radially outer portion of each blade. As viewed in plan, each blade is generally convex-shaped along its radially outer portion. According to the example, the stirring blades, that is, the plurality of blades, of the pulsator have different slopes and S-shape as viewed in plan to make it possible for the laundry and water to be easily moved radially between an inner area and an outer area of the base during the pulsator being rotated clockwise and counter clockwise.

However, though the laundry and water are smoothly moved from the inner area to the outer area of the base, the pulsator causes the laundry to be tangled and twisted since a heart-type water flow which is developed by the pulsator develops a convergence of the laundry in a central portion of the washing tub.

SUMMARY OF THE INVENTION

It is an object of the present invention to provide a pulsator for a washing machine which can prevent the laundry from concentrating into a central portion of the washing tub of a washing machine during washing.

In order to achieve the above object, a pulsator according to the present invention includes a base, a post protruded upwardly from a upper surface of the base, a plurality of blades extended radially with respect to the post and outwardly the base, and protruded upwardly on the upper surface of the base, and a plurality of vanes formed on a upper portion of the post, extended radially and outwardly with respect to the upper portion of the post.

According the present invention, as the pulsator is agitated, the plurality of blades develop a heart-type water flow in a tub of a washing machine in which the pulsator is installed, as a whole, and the plurality of vanes develop a water flow at a central portion of the hart-type water flow. The water flow developed by the plurality of vanes prevents the laundry from collecting at a central portion of the tub, so that the twisting and tangling of the laundry caused by the heart-type water flow can be minimized and a washing efficiency of the washing machine is improved.

BRIEF DESCRIPTION OF THE DRAWINGS

The foregoing and other objects, aspects and advantages will be better understood from the following detailed description of preferred embodiments of the invention with reference to the drawings, in which.

DESCRIPTION OF THE PREFERRED EMBODIMENT

Preferred embodiments of the present invention will be illustrated below with reference to the accompanying drawings.

Figure 1:
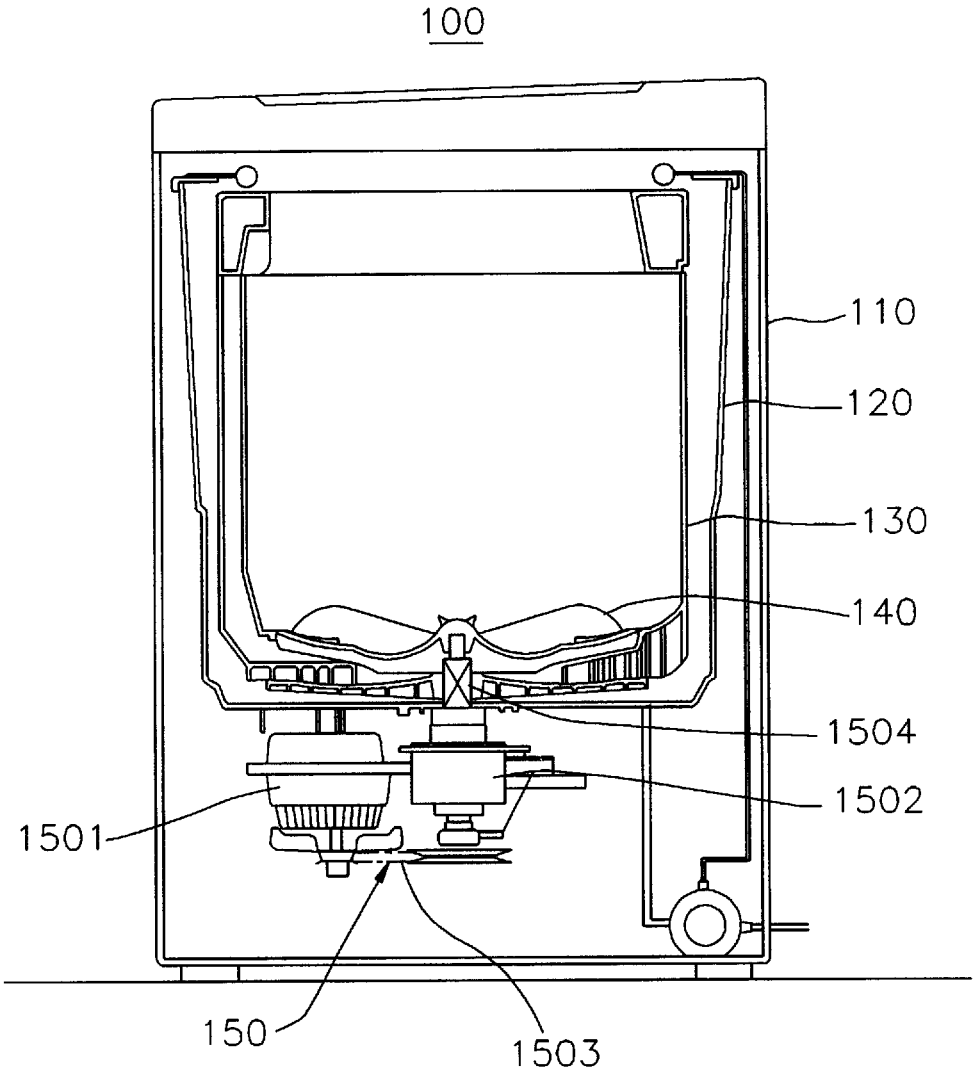
FIG. 1 is a cross-sectional view of an automatic washing machine with a pulsator installed.

FIG. 1 is a sectional view to show the construction of a conventional washing machine.

In FIG. 1, a washing machine 100 includes a main body 110, a tub 120, a spinning tub 130, a pulsator 140, and a driving device 150. The main body 110 resiliently supports the tub 120 therein through a resilient supporting mechanism (not shown). The spinning tub 130 made, for example, of plastic is arranged in the tub and has on its peripheral wall a plurality of holes (not shown). The pulsator 140 is disposed in the lower portion of the spinning tub 130 to be rotated in clockwise and counterclockwise directions according to a driving force which is provided by the driving device 150. The driving device 150 includes a driving force-generating motor 1501, a clutch 1502 which can connect or disconnect the driving force of the motor transmitted through a pulley 1503, and a driving shaft 1504 which transmits the driving force of the motor 1501 to the pulsator 140 or the spinning tub 130.

Therefore, when the laundry (not shown) has been put into the spinning tub 130 of the washing machine 100, and the motor 1501 is operated by a control program or data set by a user, the driving force of the motor 1501 is transmitted to the clutch 1502 by way of the pulley 1503.

The clutch 1502 transmits the driving force of the motor 1501, which is transferred through the pulley 1503 during washing or spin drying and the like, to the pulsator 140 or to the spinning tub 130 through the driving shaft 1504.

In other words, during the washing process, the clutch 1502 is operated for transmitting the driving force of the driving device 150, and the washing machine 100 measures an amount of the laundry by operating the pulsator 140 in clockwise and counterclockwise directions.

When the amount of the laundry is measured, washing water is supplied by a tap (not shown) according to the amount of the laundry, and the driving device operates the pulsator to be rotated in the clockwise and count clockwise directions. A friction force and/or turbulence generated by the operation of the pulsator 140 between the washing water, laundry, pulsator 140 and the spinning tub 130 performs washing the laundry.

The clutch 1502, during a spin cycle, transmits the driving force of the motor 1501 to the spinning tub 130 so as to rotate the spinning tub 130 in a high revolution for performance of spin driving. Of course, before the spin cycle, draining is performed.

The conventional washing machine 100 so operated in the above operating process performs repeatedly once or up to several times the washing water supply, washing, draining, spin cycle, and rinsing procedures in accordance with a control program, the user's setting data or the amount of the laundry.

First Embodiment

Figure 2:
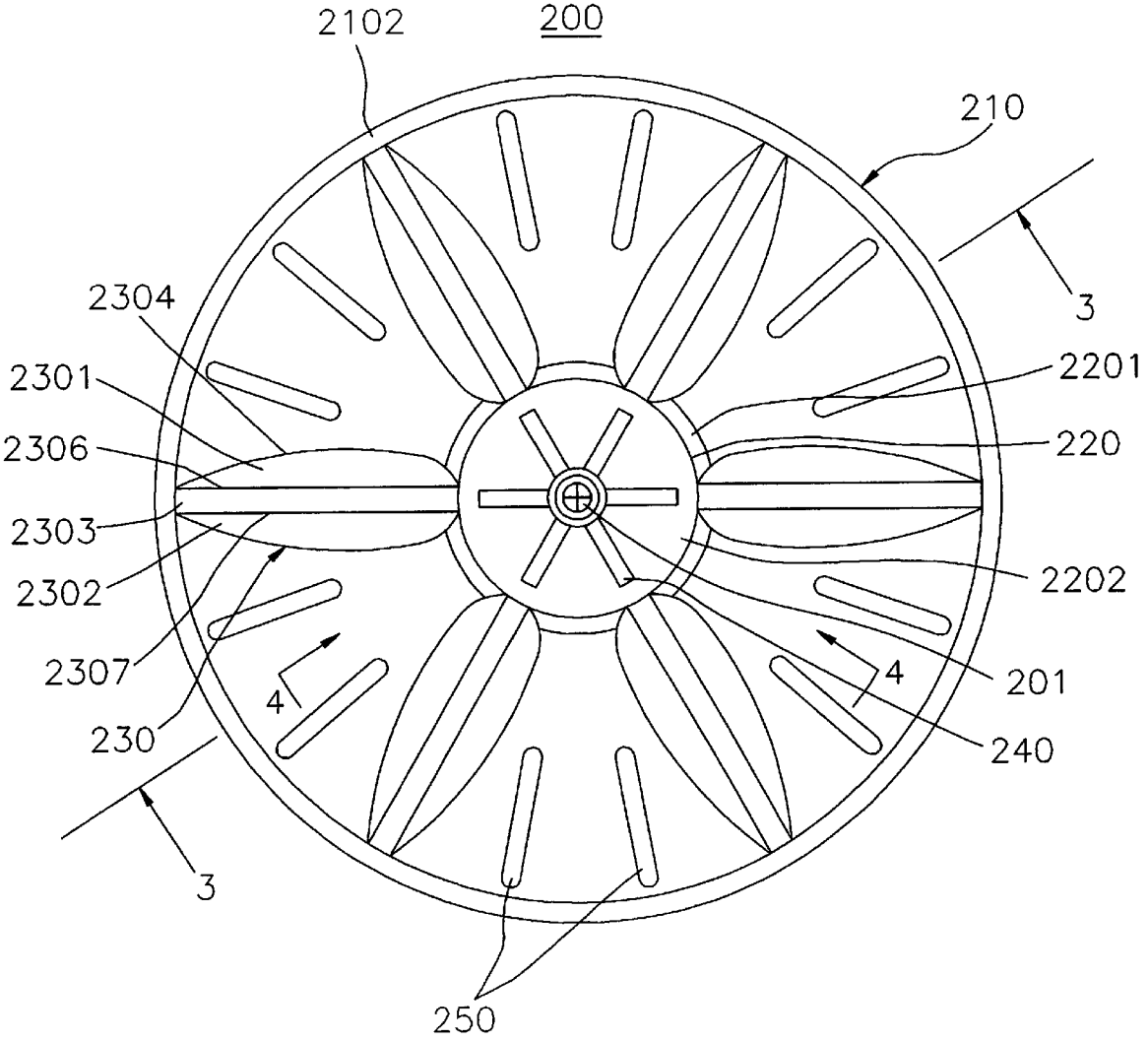
FIG. 2 is a plan view of a pulsator according to a first embodiment of the present invention.
Figure 3:
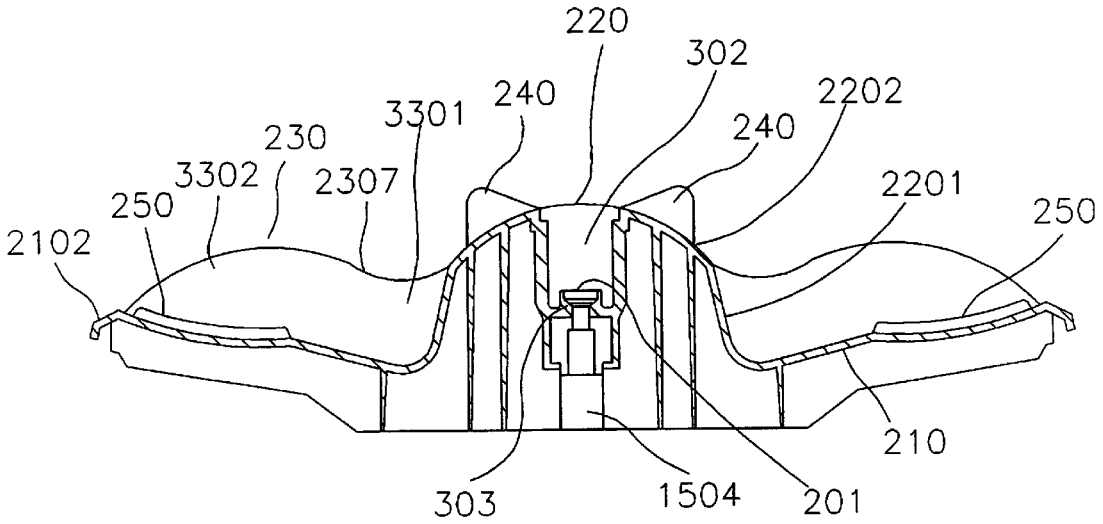
FIG. 3 is a sectional view of the pulsator taken along lines 3—3 of FIG. 2.
Figure 4:
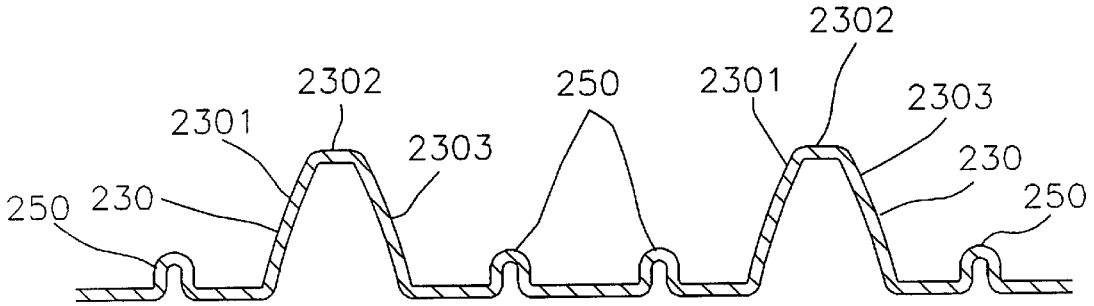
FIG. 4 is a sectional view of the pulsator taken along lines 4—4 of FIG. 2.

FIG. 2 is a plan view of a pulsator according to a first embodiment of the present invention, FIG. 3 is a sectional view of the pulsator taken along lines 3—3 of FIG. 2, and FIG. 4 is a sectional view of the pulsator taken along lines 4—4 of FIG. 2.

With reference to FIG. 2, a pulsator 200 according to a first embodiment of the present invention includes a base 210, a post 220, a plurality of blades 230, and a plurality of vanes 240.

The base 210 has substantially a disc-shape. The base 210 is slightly radially inwardly inclined with respect to a vertical center axis thereof, and has a peripheral rim 2102 which is integrally formed therewith along the outer periphery of the base 210. The peripheral rim 2102 is downwardly bent to form a skirt shape along the outer periphery. The base 210 is connected to the driving shaft 1504 on a center portion of the base 210, as shown in FIGS. 1 and 3, so as to be rotated together with the driving shaft 1504. Preferably, the base 210 has a perforation 303 formed at the center portion thereof in order for the driving shaft 1504 to be inserted into the perforation. The base 210 is connected with the inserted driving shaft 1504 by a screw 201.

The post 220 is integrally formed with the base 210 on the center portion of the base 210, enclosing the perforation therein, and is upwardly protruded from the upper surface of the base 210 along the vertical center axis of the base 210. The post 220 has a side peripheral surface 2201 which is, as shown in FIG. 3, outwardly inclined to the vertical center axis from a middle portion of the post 220 to the upper surface of the base 210, such that the side peripheral surface 2201 of the post 220 is substantially formed in a conical shape, and the upper surface 2202 of the post 220 is substantially formed in a semi-spherical shape. The post 220 has a central recess 302 which is formed in an upper portion of the post 220 along the vertical center axis of the base 210, so that the screw 201 can be screwed into the driving shaft 1504 from the bottom of the central recess 302. Preferably, a diameter of the central recess 302 is larger than that of a head of the screw 201, so that the screw head is inserted into the central recess 302 of the post 220.

The pulsator 200 includes the plurality of blades 230. The plurality of blades 230 may have more than at least two blades. Each of the plurality of blades 230 is upwardly protruded from the upper surface of the base 210 and radially extended from the side peripheral surface 3201 of the post 220 to the peripheral rim 2102 formed along the periphery of the base 210. The plurality of blades 230 are symmetrically formed with respect to the vertical center axis in order to uniformly generate a water flow in the tub 120. Each of the plurality of blades 230 is concaved on an inner portion of an upper surface 2303 thereof and convexed on an outer portion of the upper surface 2303 thereof, as viewed in cross section.

Further, referring to FIGS. 2 through 4, each of the plurality of blades 230 has a first side surface 2301, a second side surface 2302, and the upper surface 2303. The upper surface 2303 has a certain width, one edge of the first side surface is connected with one edge of the upper surface 2303, and one edge of the second surface is connected with another edge of the upper surface 2303, to thereby form two straight lines 2306 and 2307 when viewed in plain. The upper surface 2303 has a rectangular shape when viewed in plane. The base 210 and each of the first and second side surfaces 2301 and 2302 define two lines 2304 and 2305 on the upper surface of the base 210. Each of the two lines 2304 and 2305 has a shape of a curved line when viewed in plan.

The pulsator 200 has the plurality of vanes 240. In this embodiment, six vanes are employed each of which is equal to one another in shape, dimensions and operation. The plurality of vanes 240 are symmetrically formed on the upper surface 2202 of the post 220 with respect to the vertical center axis of the base 210. Each of the plurality of vanes 240 extends radially and outwardly from the central recess 302 of the uppermost portion of the semi-spherical portion of the post 220. Each of the plurality of vanes 240 is protruded from the upper surface 2202 of the post 220.

The pulsator 200 has a plurality of bosses 250, as shown in FIGS. 2 through 4, each of which is upwardly protruded from the upper surface of the base 210. The plurality of bosses 250 are radially extended on the base 210 in a bar-shape, each of which occupies a portion of the radius of the base 210. Preferably, there are provided two bosses 250 between two adjacent blades.

As illustrated in FIG. 1, while a washing machine is operated, the pulsator 200 is agitated in the tub 120. As the pulsator 200 is agitated, the plurality of blades 230 provides a centrifugal force to a washing water between the plurality of blades 230. The washing water obtained the centrifugal force from the plurality of the blades 230 flows radially from the central portion of the pulsator 200 to the inner wall of the tub 120 at the lower portion of the tub 120. The plurality of blades 230 of the pulsator 200 develops the most flow velocity of the washing water at the end portion thereof since the centrifugal force is more powerful at the end portion of the plurality of blades 230 than at any other portion of the plurality of blades 230. And, since the centrifugal force is powerless at the center of the pulsator 200, a weak flow velocity of the washing water is developed at the central portion of the pulsator 200. Therefore, the washing water is upwardly elevated along the inner wall of the tub 120 and is downwardly fallen down at a central portion of the tub 120, so that the pulsator 200 develops a heart-type water flow to the vertical center axis of the base 210, as a whole.

The heart-type water flow causes the laundry to collect in the central portion of the tub 120 since the flow velocity of the washing water developed in the central portion of the tub 120 is lower than that in the inner wall of the tub 120, such that the laundry may be twisted and tangled. But, the plurality of vanes 240 develop a water flow at the central portion of the tub 120. That is, the plurality of vanes 240 develops a flow of the washing water at the peripheral portion of the plurality of vanes 240, such that the washing water having a lower velocity at the central portion of the tub 120 is pushed to the outer portion of the plurality of vanes 240. And, The washing water flow at the central portion of the tub 120 which is developed by the plurality of vanes 240 prevents the laundry from collecting in the central portion of the tub 120.

Therefore, the pulsator 200 prevents the laundry from collecting at the central portion of the tub 120 by developing the water flow at the central portion of the tub 120 by the plurality of vanes 240, so that the twisting and tangling of the laundry developed by the heart-type water flow can be minimized in this manner and a washing efficiency of the washing machine is improved.

Second Embodiment

Figure 5:
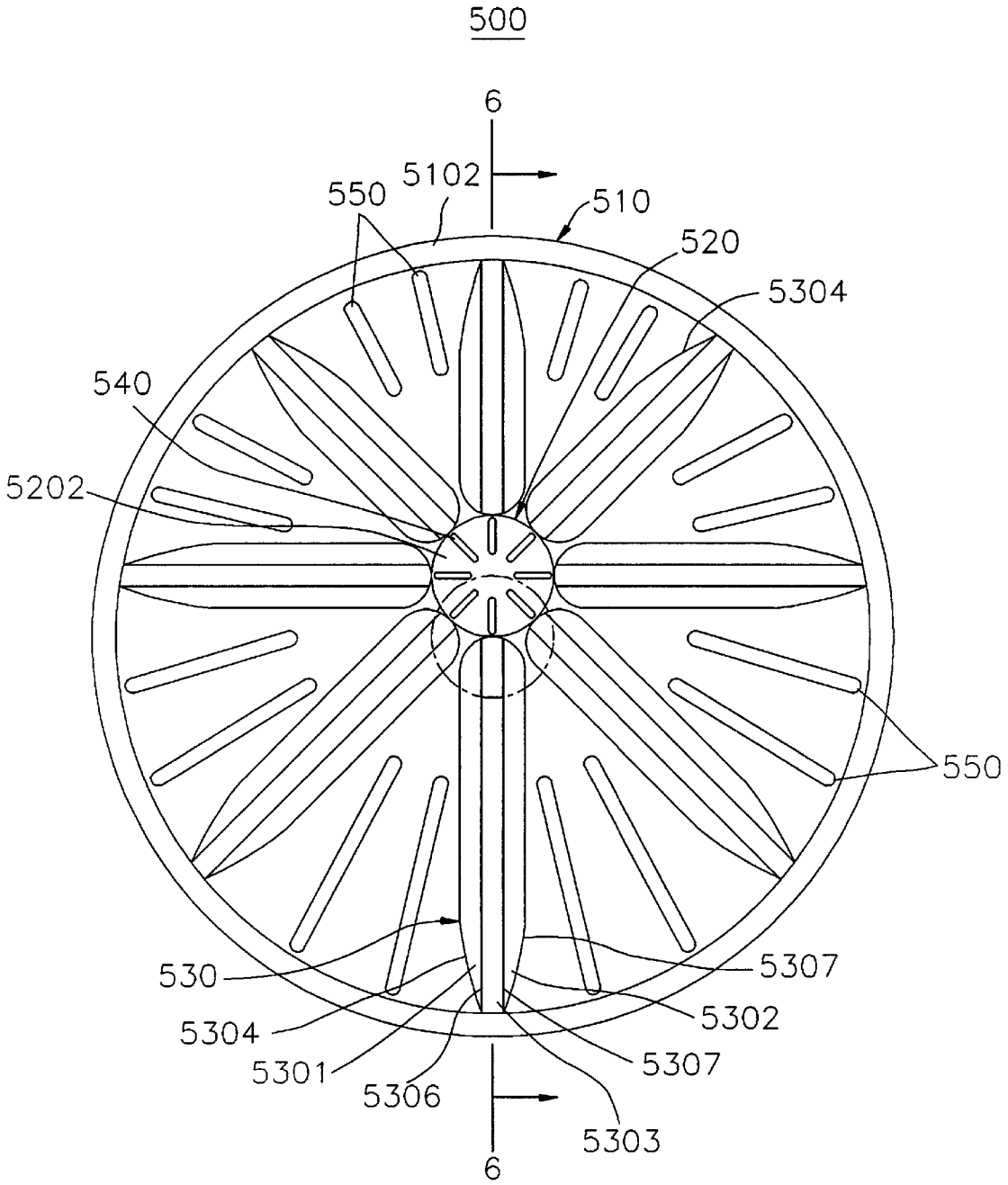
FIG. 5 is a plan view of a pulsator according to a second embodiment of the present invention.
Figure 6:
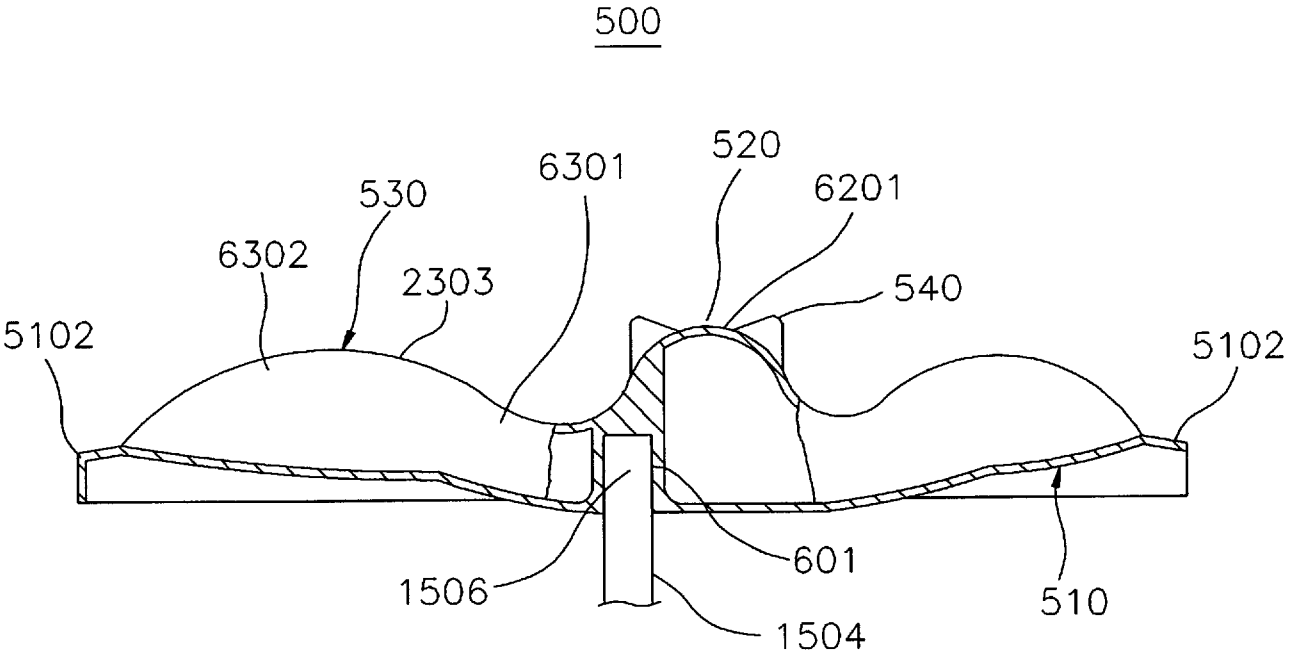
FIG. 6 is a sectional view of the pulsator taken along lines 6—6 of FIG. 5.

FIG. 5 is a plan view of another embodiment of an pulsator according to the present invention. FIG. 6 is a sectional view of the pulsator taken along lines 6—6 of FIG. 5.

Referring to FIG. 5, a pulsator 500 according to a first embodiment of the present invention includes a base 510, a post 520, blades 530, and vanes 540.

The base 510 extends radially with respect to a vertical center axis thereof, and is disc-shaped. The base 510 is slightly inclined radially inwardly to the first vertical center axis, and has a peripheral rim 5102 which is integrally formed therewith at the outer end thereof. The peripheral rim 5102 is downwardly bent with respect to the upper surface of the base 510. The base 510 is connected to the driving shaft 1504, as shown in FIGS. 1 and 6, so as to be rotated together with the driving shaft 1504. Preferably, the base 510 has a connecting recess 601 formed at the center thereof in order to be connecting to the driving shaft 1504. The base 510 is connected to the driving shaft 1504 by inserting a end portion 1506 of the driving shaft 1504, as shown in FIG. 6.

The post 520 has a second vertical center axis, which is parallel with the first vertical center axis of the base 510, and passes through the center region of the post 520 and the surface of the base 510. The post 520 is upwardly protruded from a upper surface of the base 510 along the second vertical center axis. The post 520 is substantially semi-spherical (or dome-shaped), as shown in FIG. 6. The post 520 has as a radius as a length between the first and second vertical axes The pulsator 500 includes at least two blades 530. Each of the blades 530 is upwardly protruded from the upper surface of the base 510 and radially extended from a outer circumference of the post 520 to the peripheral rim 5102 of the base 210 with respect to the second vertical center axis thereof. One of the blades 530 extends outwardly from the fist vertical axis, as shown in FIG. 6. The blades 230 is symmetrically formed with respect to the post 520. That is, the blades 530 is eccentrically formed with respect to the first vertical center axis of the base 510. Each of the blades 530 is upperwardly concaved at a inner portion with respect to the base 510 and convexed at a outer portion of the base 510 when viewed in the side.

In other words, referring to FIGS. 5 and 6, each of the blades 530 has a first side surface 5301, a second side surface 5302, and a upper surface 5303. The upper surface 5303 of the blade 530 is formed by the first and second side surface 5301 and 5302, and has a shape of a right-angled tetragon when viewed in plane. The base 510 and each of the first and second side surface 5301 and 5302 define two lines, on the upper surface of the base 510, each of which has a shape of a curved line when viewed in plan. Referring to FIG. 6, each of lines defined by the upper surface 5303 and the first and second side surfaces 5301 and 5302 has a first portion 6301 which is radially extended from the post 530 and a second portion 6302 which is extended from the radially outer end of the first portion 6301. The first portion 6301 has a concave shape and extends from the end of the post 520 when viewed from the side. And, the second portion 6302 has a convex shape and ends at the peripheral rim 5102 when viewed from the side.

Referring to FIG. 5, the pulsator 500 has eight vanes 540 which are equal to one another in their shape. The vanes 240 are symmetrically formed on the surface of the post 520 with respect to the second vertical center axis of the post 520. Each of the vanes 540 extends radially and outwardly from the uppermost portion of the post 520. The vanes 540 stand on the surface of the post 520.

The pulsator 500 has a plurality of bosses 550, as shown in FIGS. 5 and 4, which are upwardly protruded from the upper surface of the base 210. The bosses 550 are radially extended on the base 510, and are bar-shaped. Preferably, there are provided two bosses 550 between two adjacent blades 530.

Operations of the pulsator for a washing machine according to the second embodiment of the present invention will be described below.

As mentioned in description of the first embodiment, while the washing machine 100 is operated, the pulsator 500 generates a washing water flow, such as a heart-type water flow, for washing the laundry.

But, the plurality of blades 530 are eccentric with respect to the rotation center thereof, so that the pulsator 500 develops a eccentric heart-type water flow which has on the post 520, a eccentric vertical center axis which is eccentric with respect to the rotation center of the base 510. And, since the eccentric vertical center axis of the eccentric heart-type water flow follows the second vertical center axis of the post 520, the eccentric hart-type water flow which is developed by the plurality blades 530 is developed on the post 520. And, the plurality of vanes 540 develops a water flow at the periphery of the post 520, such that the washing water having a lower velocity at the peripheral portion of the post 520 is pushed to the outer portion of the plurality of vanes 540. And, The water flow which is developed by the plurality of vanes 540 prevents the laundry from collecting into a portion where the eccentric vertical center axis is developed.

Therefore, the pulsator 500 prevents the laundry from collecting at the upper portion of the post 520 since the water flow is developed at the periphery of the post 520 by the plurality of vanes 540, so that the twisting and tangling of the laundry caused by the eccentric heart-type water flow is minimized and a washing efficiency of the washing machine is improved.

While the invention has been described in terms of preferred two embodiments, those skilled in the art will recognize that the invention can be practiced with modification within the spirit and scope of the appended claims.

What is claimed is:

1. A pulsator for a washing machine, the pulsator comprising:

a base extended symmetrically and radially with respect to a vertical center axis thereof which passes through a center of the base, the base having an upper surface which is inwardly and radially inclined with respect to the vertical center axis;

a post protruded upwardly from the upper surface of the base, the post having a side peripheral surface which is inclined with respect to the vertical center axis, wherein a lower portion of the post is conic and an upper portion of the post is semi-spherical;

a plurality of blades extended radially and outwardly with respect to the vertical center axis and from the side peripheral surface, and the plurality of blades protruded upwardly on the upper surface of the base; and a plurality of vanes formed on an upper portion of the post, extended radially and outwardly with respect to the upper portion of the post, wherein the upper surface of the base is inclined from an outer periphery of the base to an outer circumference of the post with respect to the vertical center axis.

2. A pulsator for a washing machine as recited in claim 1, further comprising a plurality of bosses protruded upwardly from an upper surface of the base and extended radially on the base.

3. A pulsator for a washing machine as recited in claim 1, wherein each of the plurality of blades is upperwardly concaved at an inner portion of the base and convexed at an outer portion of the base when viewed in a side.

4. A pulsator for a washing machine as recited in claim 1, wherein said base has a perforation formed in the center thereof, so that the base is connected to a driving shaft by engaging a screw through the perforation to the driving shaft.

5. A pulsator for a washing machine as recited in claim 1, wherein said base includes a peripheral rim which is integrally formed along the outer periphery of the base, the peripheral rim being downwardly bent to form a skirt shape along the outer periphery.

6. A pulsator for a washing machine as recited in claim 3, wherein each of the plurality of blades includes a first side surface, a second side surface, and an upper surface, wherein the upper surface has a certain width, one edge of the first side surface is connected with one edge of the upper surface, and one edge of the second surface is connected with another edge of the upper surface, thereby forming two lines when viewed in a plane, wherein the upper surface has a rectangular shape when viewed in a plane, the base and each of the first and second side surfaces define two lines on the upper surface of the base, and each of the two lines has a shape of a curved line when viewed in a plane.

7. A pulsator for a washing machine, the pulsator comprising:

a base having a first vertical center axis which passes through a center of the base, and extended radially from the first vertical center axis;

a post having a second vertical center axis which is spaced from and parallel to the first vertical center axis and which passes through a center region of the post and an upper surface of the base, and protruded upwardly from the upper surface of the base along the second vertical center axis;

a plurality of blades extended radially with respect to the second vertical center axis, and protruded upwardly on the upper surface of the base, such that the plurality of blades are asymmetrically formed with respect to the first vertical center axis; and a plurality of vanes formed on an upper portion of the post, and extended radially and outwardly with respect to the second vertical center axis, wherein the base is rotated on the first vertical center axis when the pulsator is agitated and the upper surface of the base is inwardly and radially inclined with respect to the second vertical center axis.

8. A pulsator for a washing machine as recited in claim 7, further comprising a plurality of bosses protruded upwardly from the upper surface of the base and extended radially on the base.

9. A pulsator for a washing machine as recited in claim 7, wherein said post has a semi-spherical shape.

10. A pulsator for a washing machine as recited in claim 7, wherein each of the plurality of blades is upperwardly concaved at an inner portion of the base and convexed at an outer portion of the base when viewed in a side.

11. A pulsator for a washing machine as recited in claim 7, wherein said base has a connecting recess which is formed in the central portion of the base, so that the base is connected to a driving shaft by inserting an end portion of the driving shaft into the connecting recess.

12. A pulsator for a washing machine as recited in claim 7, wherein said plurality of blades are radially extended from a side peripheral surface of the post to an end portion of the base with respect to the second vertical center axis.

13. A pulsator for a washing machine as recited in claim 7, wherein said base includes a peripheral rim which is integrally formed along an outer periphery of the base, the peripheral rim being downwardly bent to form a skirt shape along the outer periphery.

14. A pulsator for a washing machine as recited in claim 10, wherein each of the plurality of blades includes a first side surface, a second side surface, and an upper surface, wherein the upper surface has a certain width, one edge of the first side surface is connected with one edge of the upper surface, and one edge of the second surface is connected with another edge of the upper surface, thereby forming two lines when viewed in a plane, wherein the upper surface has a rectangular shape when viewed in a plane, the base and each of the first and second side surfaces define two lines on the upper surface of the base, and each of the two lines has a shape of a curved line when viewed in a plane.

15. A pulsator for a washing machine as recited in claim 7, wherein said base includes a peripheral rim which is integrally formed along an outer periphery of the base, the peripheral rim being downwardly bent to thereby form a skirt shape along the outer periphery.

16. A pulsator for a washing machine, the pulsator comprising:

a base having a first vertical center axis which passes through a center of the base, and extended radially from the first vertical center axis, wherein the base includes an upper surface which is inwardly and radially inclined from an outer periphery of the base to an outer circumference of a post with respect to a second vertical center axis;

a peripheral rim formed integrally along the outer periphery of the base, and bent downwardly to thereby form a skirt shape along the outer periphery;

the post having the second vertical center axis which is spaced from and parallel to the first vertical center axis and which passes through a center region of the post and an upper surface of the base, and protruded upwardly from the upper surface of the base along the second vertical center axis;

a plurality of blades extended radially with respect to the second vertical center axis, and protruded upwardly on the upper surface of the base, such that the plurality of blades are asymmetrically formed on the upper surface of the base, wherein each of the plurality of blades is radially extended from a side peripheral surface of the post to the outer periphery of the base with respect to the second vertical center axis; and a plurality of vanes formed on an upper portion of the post, and extended radially and outwardly with respect to the second vertical center axis.

* * * * *